US006617957B2

(12) United States Patent
Ishikawa

(10) Patent No.: US 6,617,957 B2
(45) Date of Patent: Sep. 9, 2003

(54) MULTIDIRECTIONAL INPUT DEVICE

(75) Inventor: Shinji Ishikawa, Miyagi-ken (JP)

(73) Assignee: Alps Electric Co., Ltd., Tokyo (JP)

( * ) Notice: Subject to any disclaimer, the term of this patent is extended or adjusted under 35 U.S.C. 154(b) by 0 days.

(21) Appl. No.: 09/809,240

(22) Filed: Mar. 15, 2001

(65) Prior Publication Data

US 2002/0053968 A1 May 9, 2002

(30) Foreign Application Priority Data

Mar. 23, 2000 (JP) ..... 2000-087095
Mar. 23, 2000 (JP) ..... 2000-087096

(51) Int. Cl.[7] ..... H01C 10/30
(52) U.S. Cl. ..... 338/128; 338/131; 74/471 XY
(58) Field of Search ..... 338/128, 131; 74/473.12, 471 XY

(56) References Cited

U.S. PATENT DOCUMENTS 3,939,451 A * 2/1976 Kasahima ..... 338/128
4,587,510 A 5/1986 Kim
4,620,176 A * 10/1986 Hayes ..... 338/128
4,857,881 A 8/1989 Hayes
5,229,742 A * 7/1993 Miyamoto et al. ..... 338/128
6,002,351 A * 12/1999 Takeda et al. ..... 338/128
6,064,369 A * 5/2000 Okabe et al. ..... 338/128
6,078,247 A * 6/2000 Shimomura ..... 338/131
6,150,919 A * 11/2000 Shimomura ..... 338/128
6,275,139 B1 * 8/2001 Shimomura et al. ..... 338/128
6,344,620 B1 * 2/2002 Nakamura ..... 338/128

FOREIGN PATENT DOCUMENTS

JP 10-105268 4/1998
JP 11-73853 3/1999

* cited by examiner

*Primary Examiner*—Karl D. Easthom
(74) *Attorney, Agent, or Firm*—Brinks Hofer Gilson & Lione

(57) ABSTRACT

Disclosed is a multidirectional input device having a reduction in thickness and in which the inclination of the operating shaft can be smoothly effected. The device comprise first and second interlock members that are supported at both ends by support portions connected to the inside of the frame body, wherein the second interlock member has between the support portions a connecting portion having a second elongated hole, and wherein the connecting portion is arranged below the first interlock member so as to be astride the first interlock member, the connecting portion being positioned in the inner peripheral portion of a coil spring.

18 Claims, 14 Drawing Sheets

MULTIDIRECTIONAL INPUT DEVICE

BACKGROUND OF THE INVENTION

1. Field of the Invention

The present invention relates to a multidirectional input device that permits the simultaneous operation of a plurality of electric parts through the operation of a single operating shaft.

2. Description of the Related Art

As shown in FIG. 20, a conventional multidirectional input device has a box-shaped case 31. At the center of a top plate 31*a* of this case 31, there is formed a hole 31*b*. First and second interlock members 32 and 33 are rotatably supported in the case 31 so as to cross each other at right angles.

The first interlock member 32 has a substantially U-shaped connecting portion 32*a*. A first elongated hole 32*b* extends longitudinally through the connecting portion 32*a*. The lower portion of one end portion of the connecting portion 32*a* comprises an engagement claw 32*c* protruding in a direction parallel to the longitudinal direction of the connecting portion 32*a*. The lower portion of each end portion of the connecting portion 32*a* further comprise protrusions 32*d* protruding in a direction perpendicular to the engagement claw 32*c*.

Below the first interlock member 32, there is disposed a second interlock member 33 configured so as to extend in a direction perpendicular to the first interlock member 32. This second interlock member 33 has a bar-like connecting portion 33*a* and a second elongated hole 33*b* extending longitudinally through the connecting portion 33*a*.

At one end portion of the connecting portion 33*a*, there protrudes an engagement claw 33*c* in a direction parallel to the longitudinal direction of the connecting portion 33*a*. Each end portion of the connecting portion 33*a* further comprises protrusions 33*d* protruding in a direction perpendicular to the engagement claw 33*c*. A shaft support hole 33*e* extends through the second elongated hole 33*b*.

An operating shaft 34 is disposed through the hole 31*a* of the case 31. This operating shaft 34 has a bar-like cylindrical portion 34*a*. Below this cylindrical portion 34*a*, there is formed a flat portion 34*b*. A protrusion 34*c* protrudes downwardly from this flat portion 34*b*. Further, a support hole 34*d* extends through the flat portion 34*b*.

The operating shaft 34 is connected to the second interlock member 33 by pin 39, which extends through the shaft support holes 33*e* in the second interlock member 33 and the shaft support hole 34*d* in the flat portion 34*b* of the operating shaft 34. The cylinder portion 34*a* extends upwardly through the first elongated hole 32*b* of the first interlock member 32.

A rotary electric part, such as a variable resistor 35, is mounted to a first side plate 31*c* of the case 31 (shown on the left-hand side of FIG. 20). A second variable resistor 35 (not shown in FIG. 20) is connected to the second side plate 31*d*, which is perpendicular to the first side plate 31*c*. The variable resistor 35 consists of a substrate 35*a* and a slider receiver 35*b*. In this slider receiver 35*b*, there is provided an engagement hole 35*c* which can be engaged with the engagement claws 32*c* and 33*c* of the first and second interlock members 32 and 33.

Below the first and second interlock members 32 and 33, there is disposed a substantially square push-up member 36. The push-up member 36 includes an abutment portion 36*a* against which the protrusion 32*d* of the first interlock member 32 can abut, and an abutment portion 36*b* against which the protrusion 33*d* of the second interlock member 33 can abut, each being formed near the corner portion of the push-up member 36. A hole 36*c* is provided through the central portion of the push-up member 36.

A coil spring 37 is positioned below the push-up member 36, and is mounted to a bottom plate 38 so as to provide an elastic biasing force against the push-up member 36. Thus, the push-up member 36 is pushed up towards the first and second interlock members 32 and 33 by the coil spring 37.

When the operating shaft 34 of this conventional multidirectional input device is inclined in the direction of the arrow A (as shown in FIG. 21A), the flat portion 34*b* rotates within the second elongated hole 33*b* by using the pin 39 as a fulcrum. At the same time, the first interlock member 32 rotates using the protrusions 32*d* at both ends as fulcrums, thereby making it possible to operate the variable resistor 35 engaged with the engagement claw 32*c*.

As shown in FIG. 21B, when the operating shaft 34 is inclined in the direction of the arrow B, the cylindrical portion 34*a* of the operating shaft 34 moves along the first elongated hole 32*b* of the first interlock member 32. At the same time, the second interlock member 33 rotates using the protrusions 33*d* as fulcrums, thereby making it possible to operate the variable resistor 35 engaged with the engagement claw 33*c*.

When the force that has been applied in the direction of the arrow A or B of the operating shaft 34 is cancelled, the push-up member 36 is pushed upward by the elastic force of the coil spring 37, causing the first and second interlock members 32 and 33 to rotate to their initial attitude. The operating shaft 34 is therefore automatically restored to the vertical neutral position.

In this conventional multidirectional input device, it is possible to simultaneously operate two variable resistors mounted to the case 31 by inclining the operating shaft 34 in both the A and B directions. For example, it is possible to easily perform input operation through a cursor or the like on the display of a personal computer.

However, in the conventional multidirectional input device described above, the connecting portion 32*a* of the first interlock member 32 is disposed above the second interlock member 33 so as to be astride the second interlock member 33. In addition, a large gap must be formed between the top plate 31*a* of the case 31 and the second interlock member 33 so that the connecting portion 32*a* can freely rotate. As a result, it is difficult to achieve a reduction in the thickness of the conventional multidirectional input device.

Further, the positions at which the protrusions 32*d* and 33*d* of the first and second interlock members 32 and 33, respectively, abut the push-up member 36 are offset from the center of the operating shaft 34. Consequently, when the push-up member 36 is pushed downwardly by the rotation of the first or second interlock member 32 or 33, the push-up member 36 can be tilted. This results in the generation of friction and a creaking noise in the central hole 36*c* and the guide portion 38*a* of the bottom plate 38.

It is therefore impossible to smoothly push down the push-up member 36, with the resultant deterioration of the operational feeling of the operating shaft 34.

Further, the position of the lower end portion of the coil spring 37 tends to slide when the push-down member 36 is vertically moved, causing a variation in the biasing force of the coil spring 37 on the push-down member 36. This results in an unstable operational force needed to incline the operating shaft 34.

SUMMARY OF THE INVENTION

Accordingly, it is an object of the present invention to overcome the above problems. In particular, it is an object of the present invention to provide a high-performance multidirectional input device having a reduction in thickness, a superior operational feeling for the operating shaft, and a constant operating force needed for inclining the operating shaft.

As a first embodiment for solving the above problems, there is provided a multidirectional input device comprising a first interlock member that is rotatable and has a first elongated hole, a second interlock member that is arranged in a direction perpendicular to the first interlock member, that is rotatable and which has a second elongated hole, and a frame body supporting the first and second interlock members inside. An operating shaft is inserted through the first elongated hole and is rotatably supported by the first interlock member so as to be capable of inclining along the first elongated hole. A coil spring provides an elastic biasing force from below the first and second interlock members. A plurality of electric parts are connected to and operated by the first and second interlock members. Support portions are provided at both ends of the first and second interlock members for supporting the first and second interlock members inside the frame body. Wherein the second interlock member has between the support portions a connecting portion having a second elongated hole, and the connecting portion is arranged below the first interlock member so as to be astride the first interlock member, the connecting portion being positioned in the inner peripheral portion of the coil spring.

Further, as a second embodiment for solving the above problems, there is provided a multidirectional input device, wherein the connecting portion is formed in an arcuate configuration, the center of which is positioned at a rotatably supporting portion that rotatably supports the operating shaft of the first interlock member.

Further, as a third embodiment for solving the above problems, there is provided a multidirectional input device, wherein the support portions of the first and second interlock members are positioned at the same height as the frame body.

Further, as a fourth embodiment for solving the above problems, there is provided a multidirectional input device, wherein the coil spring elastically biases the portions in the vicinity of the support portions of the first and second interlock members.

Further, as a fifth embodiment for solving the above problems, there is provided a multidirectional input device, wherein there is provided between the first and second interlock members and the coil spring a spring receiving member capable of performing the positioning of the coil spring, and wherein the movement of the spring receiving member when the first and second interlock members are rotated is guided by the first and second interlock members.

Further, as a sixth embodiment for solving the above problems, there is provided a multidirectional input device, wherein there is provided below the first and second interlock members a guide portion capable of guiding the movement of the spring receiving member.

Further, as a seventh embodiment for solving the above problems, there is provided a multidirectional input device, wherein the guide portion is formed in the vicinity of the support portions of the first and second interlock members, and wherein either the outer peripheral portion or the inner peripheral portion of the spring receiving member can be guided by the guide portion.

Further, as an eighth embodiment for solving the above problems, there is provided a multidirectional input device, wherein the inner peripheral portion of the spring receiving member is positioned at the connecting portion of the second interlock member so as to guide the movement of the spring receiving member.

Further, as a ninth embodiment for solving the above problems, there is provided a multidirectional input device, wherein the guide surface constituting the guide portion is formed in a tapered configuration.

Further, as a tenth embodiment for solving the above problems, there is provided a multidirectional input device, wherein the spring receiving member is provided with a positioning portion for performing the positioning of the upper end portion of the coil spring.

Further, as an eleventh embodiment for solving the above problems, there is provided a multidirectional input device, wherein the positioning portion is formed so as to be capable of performing the positioning of at least either the outer peripheral portion or the inner peripheral portion of the coil spring.

Further, as a twelfth embodiment for solving the above problems, there is provided a multidirectional input device, wherein there is formed in the positioning portion of the spring receiving portion an escape portion for escaping from a step generated at the start of the winding of the coil spring.

Further, as a thirteenth embodiment for solving the above problems, there is provided a multidirectional input device, wherein the frame body has a bottom plate for closing the lower portion, and wherein there is formed in this bottom plate a positioning groove for performing the positioning of the lower end portion of the coil spring.

Further, as a fourteenth embodiment for solving the above problems, there is provided a multidirectional input device, wherein there is formed in the positioning groove of the bottom plate an escape portion for escaping from a step generated at the end of the winding of the coil spring.

Further, as a fifteenth embodiment for solving the above problems, there is provided a multidirectional input device, wherein there is formed in the bottom plate a restricting portion for restricting the downward movement of the operating shaft when a pressurizing load is applied to the operating shaft, and wherein when the operating shaft is downwardly pressurized, the lower end portion of the operating shaft abuts the restricting portion.

DESCRIPTION OF THE PREFERRED EMBODIMENTS

Figure 5:
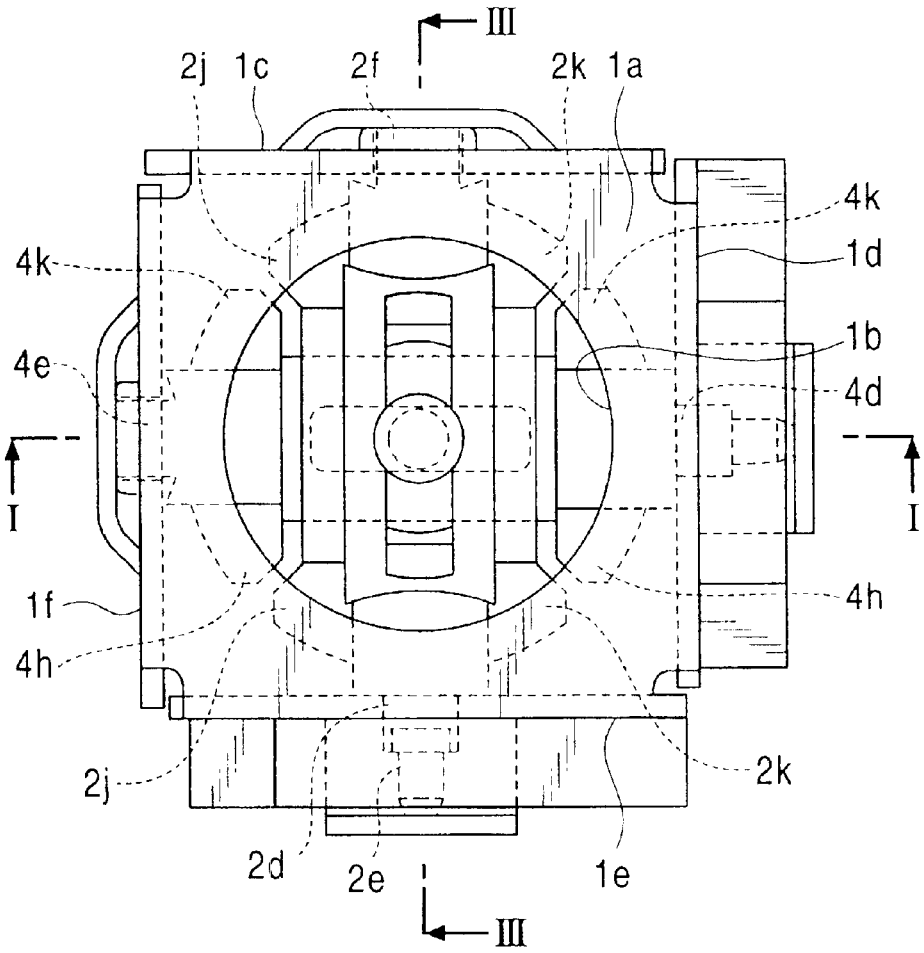
FIG. 5 is a plan view of a multidirectional input device according to an embodiment of the present invention.

As shown in FIG. 5, the multidirectional input device of the present invention comprises a box-like frame body 1 consisting of an iron plate or the like that is formed through a bending, pressing or similar process. The upper portion of the frame body 1 is covered with a top plate 1*a* having a circular operation hole 1*b* provided in the center thereof, bent side plates 1*c*, 1*d*, 1*e* and 1*f* extending downwardly from the four sides of the top plate 1*a* so as to define a hollow interior of the frame body 1.

First and second interlock members 2 and 4 are disposed within the interior of the frame body 1, and are arranged perpendicular to each other so as to form a cross-shape.

The first interlock member 2 will be described with reference to FIGS. 7 through 10. The first interlock member 2 is formed of synthetic resin, and as shown in FIG. 8, has at the center thereof a semi-circular base portion 2*a*. One arm portion 2*b* protrudes to the right, and the other arm portion 2*c* protrudes to the left.

Provided at the ends of the arm portions 2*b* and 2*c* are cylindrical support portions 2*d* and 2*f*, respectively, for supporting the first interlock member 2 on the side plates 1*c* and 1*e*, respectively, of the frame body 1.

A bar-like engagement portion 2*e* protrudes from the support portion 2*d* of the arm portion 2*b*. This engagement portion 2*e* is engaged with a rotary electric part 11 (to be described below).

Figure 7:
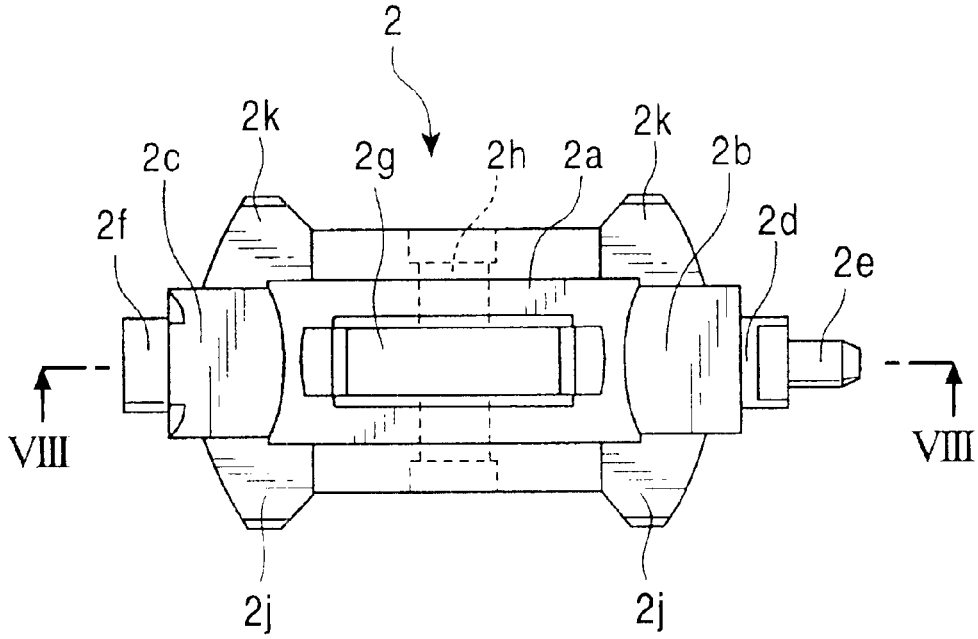
FIG. 7 is a plan view of the first interlock member according to an embodiment of the present invention.
Figure 8:
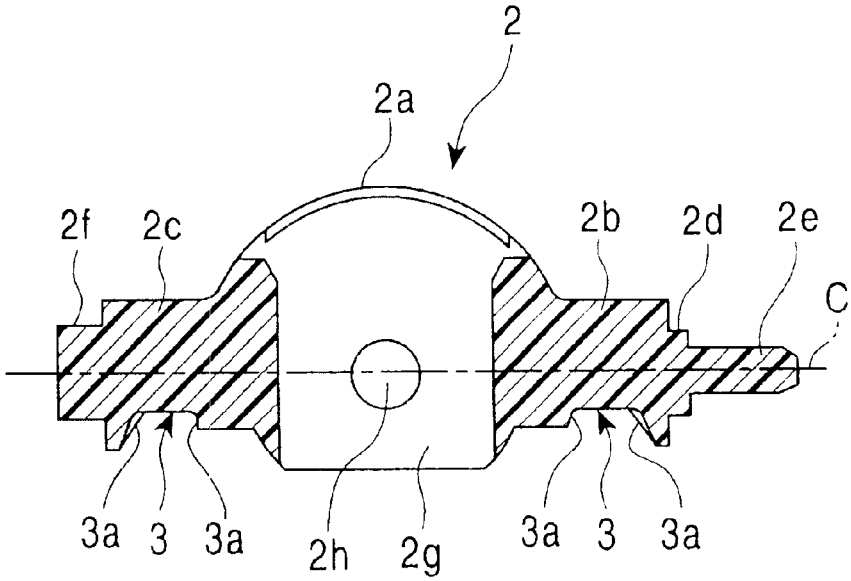
FIG. 8 is a sectional view of the first interlock member according to an embodiment of the present invention taken along the line VIII—VIII of FIG. 7.

At the center of the base portion 2*a* (as best seen in FIG. 7), there extends a first elongated hole 2*g* extending toward, or parallel with, the arm portions 2*b* and 2*c*.

In addition, the base portion 2*a* (see FIG. 8) includes a rotatably supporting hole 2*h* into which a round pin 7 described below can be fitted. The supporting hole 2*h* extends in a direction perpendicular to the first elongated hole 2*g*. The center of the rotatably supporting hole 2*h* is aligned with the line C defining the central axis of the support portions 2*d* and 2*f* (as shown in FIG. 8).

From the arm portions 2*b* and 2*c* (see FIG. 7), there protrude outwardly a pair of protrusions 2*j* and a pair of protrusions 2*k*, each of them having a substantially triangular configuration. The protrusions 2*j* and 2*k* are formed so as to be capable of abutting the ring-like base portion 8*d* of the spring receiving member 8 (to be described below).

In the vicinity of the support portions 2*d* and 2*f*, and below the arm portions 2*b* and 2*c*, there is formed a guide portion 3 capable of guiding the movement of the ring-like spring receiving member 8 (to be described below).

Figure 9:
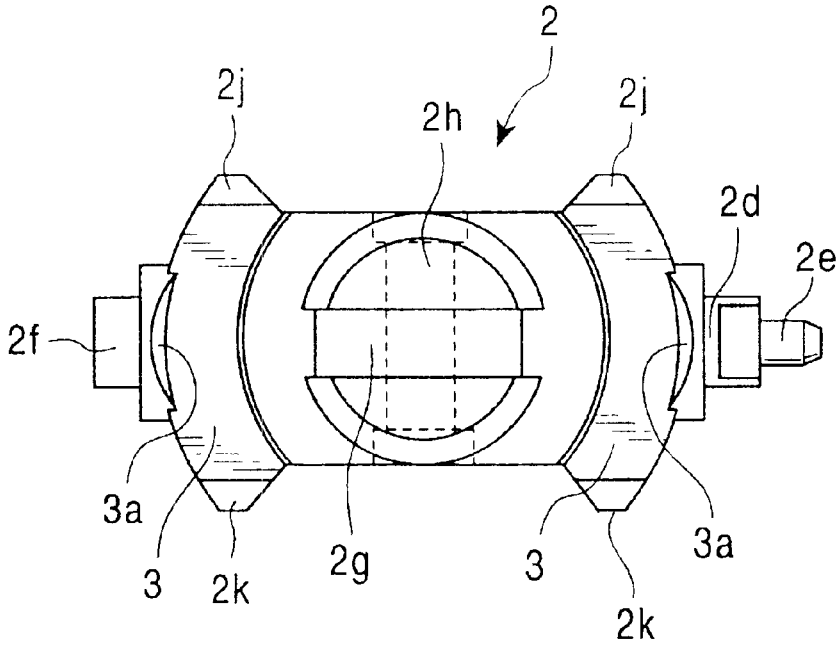
FIG. 9 is a bottom view of the first interlock member according to an embodiment of the present invention.
Figure 10:
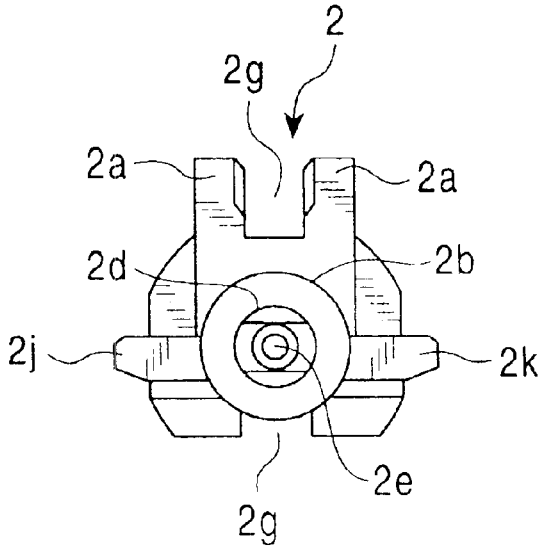
FIG. 10 is an end view of the first interlock member according to an embodiment of the present invention.

As shown in FIG. 9, the guide portions 3 are formed in the vicinity of the support portions 2*d* and 2*f* and substantially in an annular configuration between the support portions 2*d* and 2*f* and the first elongated hole 2*g*. The right and left guide surfaces 3*a* of the guide portion 3 are formed in a tapered configuration (see FIG. 8).

As shown in FIG. 5, the support portions 2*d* and 2*f* of the first interlock member 2 are rotatable, being supported by the side plates 1*c* and 1*e* of the frame body 1. While in this example the first interlock member 2 is formed of synthetic resin, it is also possible to form it from other materials such as a zinc die cast.

The second interlock member 4 will be described with reference to FIGS. 11 through 14. The second interlock member 4 consists of synthetic resin or the like, and is arranged within the frame body 1 so as to be aligned perpendicular to the first interlock member 2. As shown in FIG. 12, there is provided at the center of the second interlock, a connecting portion 4*a* having a downwardly directed arcuate configuration. From this connecting portion 4*a*, an arm portion 4*b* protrudes to the right, and an arm portion 4*c* protrudes to the left.

At the ends of the arm portions 4*b* and 4*c*, there are provided cylindrical support portions 4*d* and 4*e*, respectively, for supporting the second interlock member 4 on the side plates 1*d* and 1*f* of the frame body 1.

From the support portion 4*d* on the arm portion 4*b* side, there protrudes a bar-like engagement portion 4*f*, which is engaged with the rotary electric part 11 (to be described below).

Figure 11:
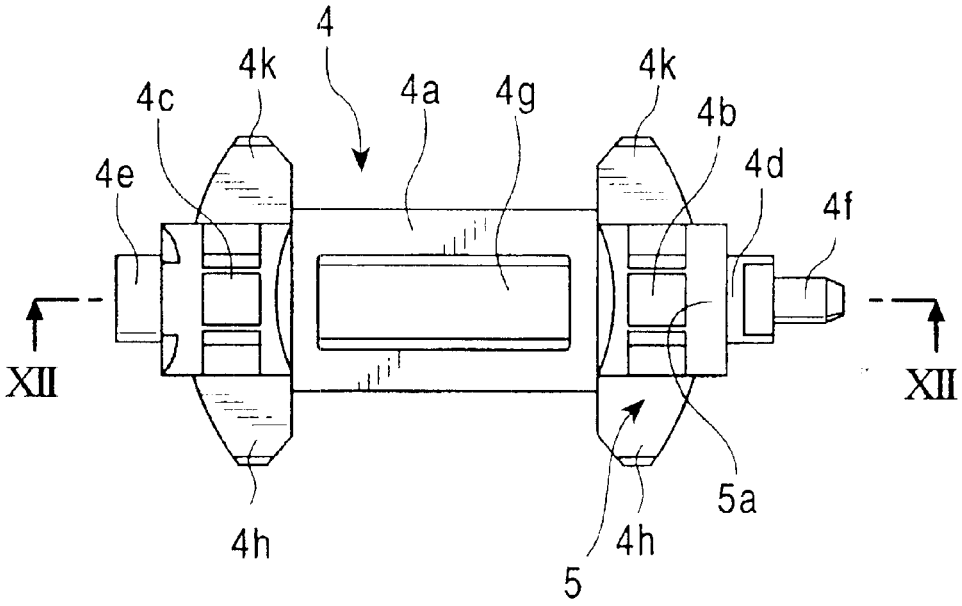
FIG. 11 is a plan view of the second interlock member according to an embodiment of the present invention.
Figure 12:
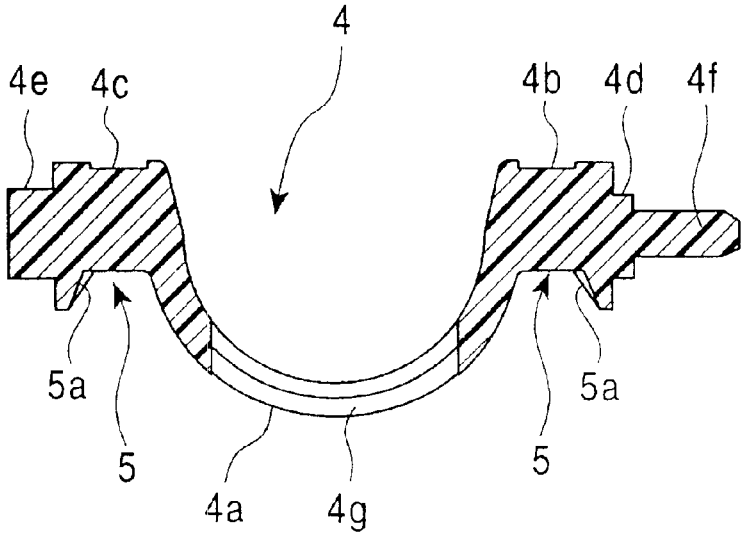
FIG. 12 is a sectional view of the second interlock member according to an embodiment of the present invention taken along the line XII—XII of FIG. 11.

Further, and as shown in FIG. 11, from the arm portions 4*b* and 4*c* there protrude outwardly a pair of protrusions 4*h* and a pair of protrusions 4*k*, each of them having a substantially triangular configuration. The protrusions 4*h* and 4*k* are formed so as to be capable of abutting the ring-like base portion 8*d* of the spring receiving member 8 (to be described below).

In the vicinity of the support portions 4*d* and 4*e* (as shown in FIG. 12), and below the arm portions 4*b* and 4*c*, there are formed a guide portion 5 capable of guiding the movement of the ring-like spring receiving member 8 (to be described below).

Figure 13:
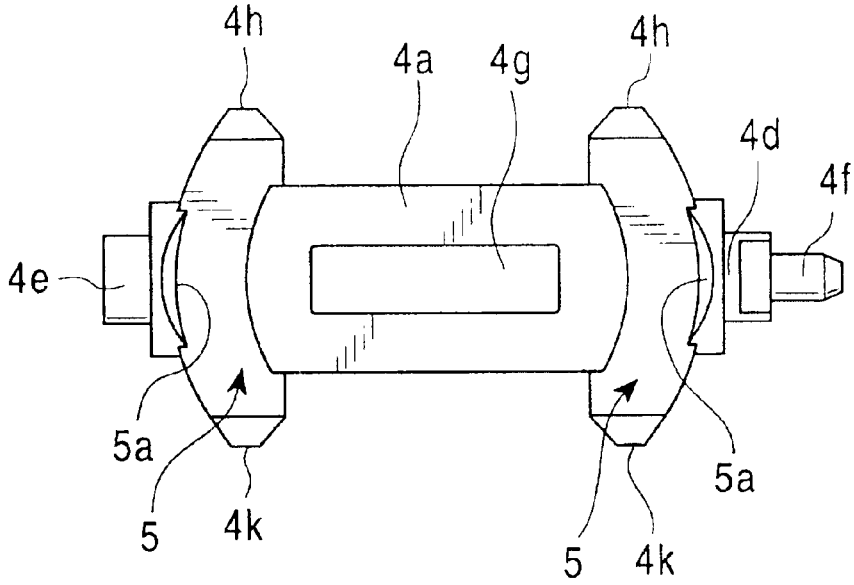
FIG. 13 is a bottom view of the second interlock member according to an embodiment of the present invention.
Figure 14:
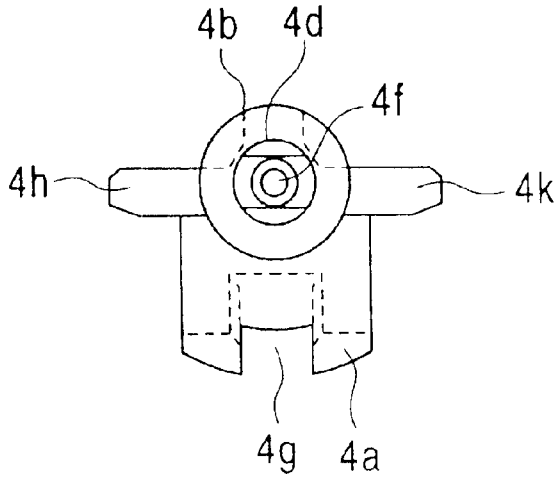
FIG. 14 is an end view of the second interlock member according to an embodiment of the present invention.

As shown in FIG. 13, the guide portions 5 are formed in a substantially annular configuration, having a tapered outer surface 5*a* formed on the outer peripheral side thereof, and an arcuate connecting portion 4*a* being formed on the inner peripheral side thereof.

As shown in FIG. 5, the support portions 4*d* and 4*e* of the second interlock member 4 are rotatable, being supported by the side plates 1*d* and 1*f* of the frame body 1.

As can best be seen in FIG. 1, the connecting portion 4*a* of the second interlock member 4 is arranged below the first interlock member 2 so as to be astride the first interlock member 2. Further, the support portions 2*d*, 2*f*, 4*d* and 4*e* of the first and second interlock members 2 and 4 are rotatably supported at the same height or elevation relative to the four side plates 1*c*, 1*d*, 1*e* and 1*d* of the frame body 1. That is, the support portions 2*d*, 2*f*, 4*d* and 4*e* of the first and second interlock members 2 and 4 are mounted so as to be positioned on the same plane as the reference line D shown in FIGS. 1 through 3.

The arcuate connecting portion 4*a* of the second interlock member 4 is arranged such that the arc center of the connecting portion 4*a* is positioned within the rotatable support hole 2*h*, which is also the rotatable support portion for rotatably supporting the operating shaft 6 (described below) on the first interlock member 2.

Figure 6A:
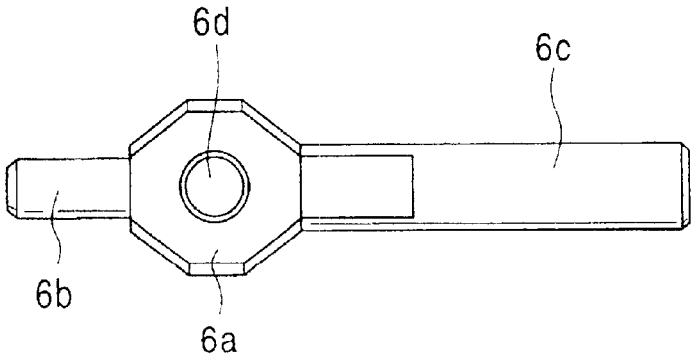
FIG. 6A is a side view of an operating shaft according to an embodiment of the present invention.
Figure 6B:
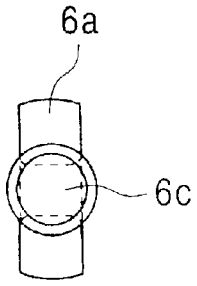
FIG. 6B is an end view of an operating shaft according to an embodiment of the present invention.

The operating shaft 6 is rotatably supported at the rotatable support hole 2*h* of the first interlock member 2. In the preferred embodiment, the operation shaft 6 consists of a metal, and as shown in FIGS. 6A and 6B, substantially comprises a flat first operating portion 6*a*, a cylindrical second operating portion 6*b* protruding to the left from the first operating portion 6*a*, and a cylindrical knob portion 6*c* protruding to the right from the first operating portion 6*a*. Substantially at the center of the first operating portion 6*a*, there is formed a rotatable support hole 6*d* for rotatably supporting the operating shaft 6 in the rotatable support hole 2*h* of the first interlock member 2.

In this operating shaft 6, the first operating portion 6*a* is positioned in the first elongated hole 2*g* of the first interlock member 2, and can be inclined in a direction parallel to the first elongated hole 2*g*. The second operating portion 6*b* is positioned in the second elongated hole 4*g* of the connecting portion 4*a* of the second interlock member 4, and is movable along the length of the second elongated hole 4*g*.

Figure 1:
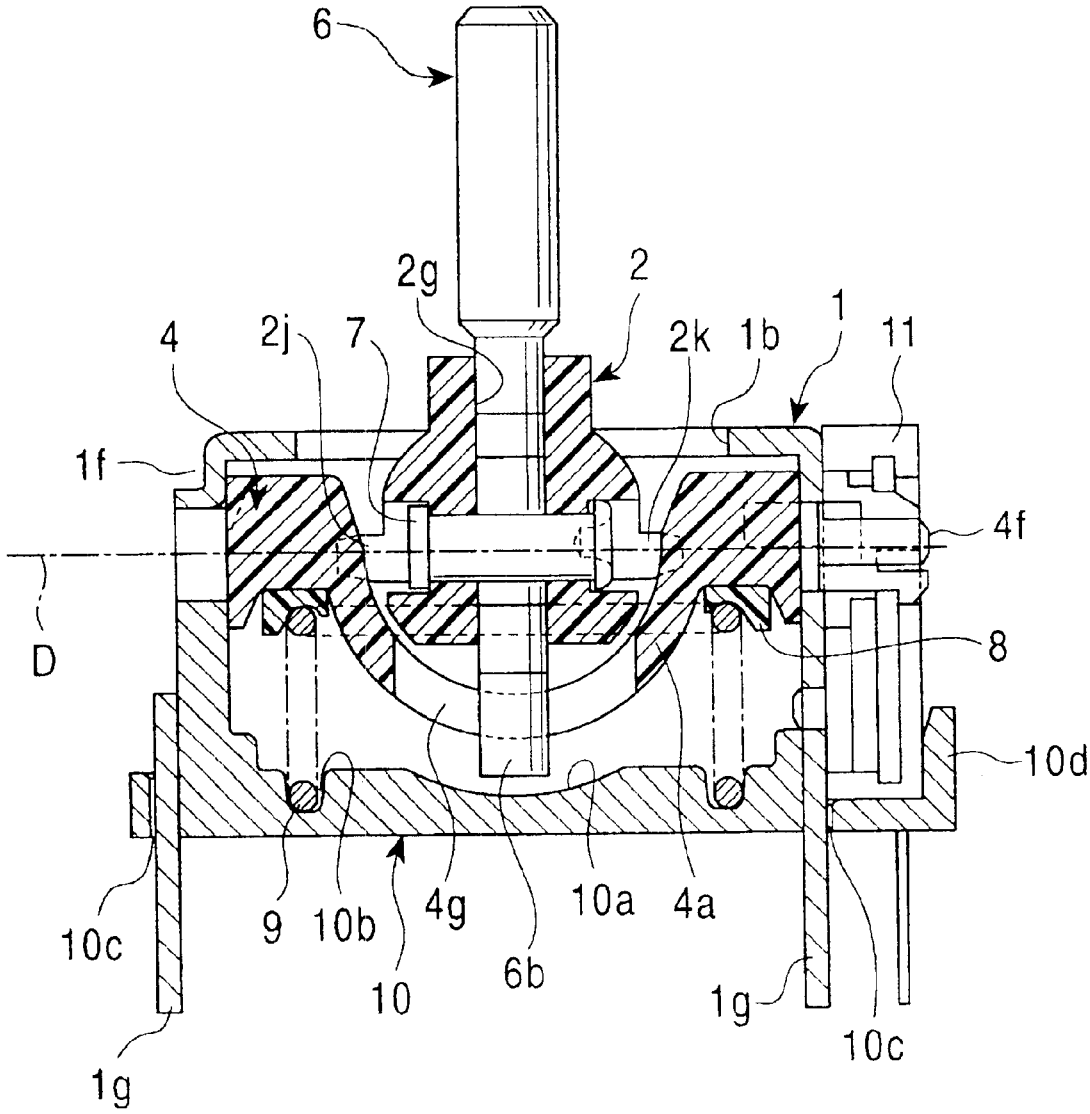
FIG. 1 is a sectional view of a multidirectional input device according to an embodiment of the present invention taken along the line I—I of FIG. 5.

As shown in FIG. 1, the operating shaft 6 is assembled by inserting the first operating portion 6*a* into the first elongated hole 2*g* of the first interlock member 2 and, with the rotatable support holes 2*h* and 6*d* being aligned with each other, the round pin 7 is inserted through these rotatable support holes 2*h* and 6*d*. Once assembled, the forward end portion of the round pin 7 is crimped from the other side, whereby the operating shaft 6 is held by the first interlock member 2. Inclination of the operating shaft 6 is possible by rotation of the operating shaft 6 about the round pin 7 (i.e., by using the round pin 7 as a fulcrum).

Figure 15A:
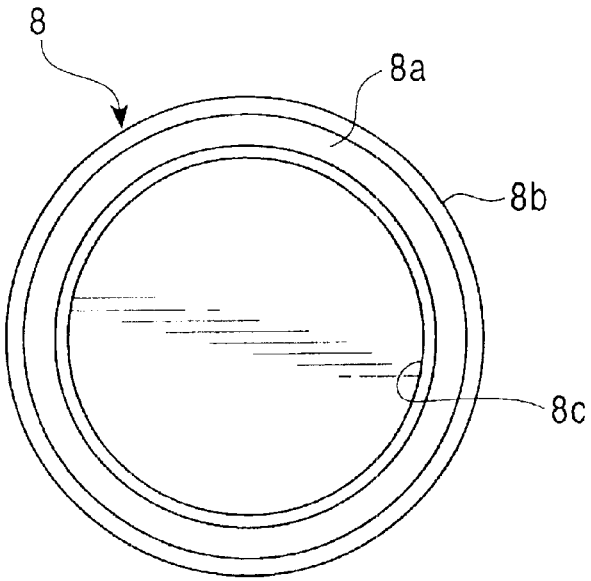
FIG. 15A is a plan view of a spring receiving member according to an embodiment of the present invention.
Figure 15B:
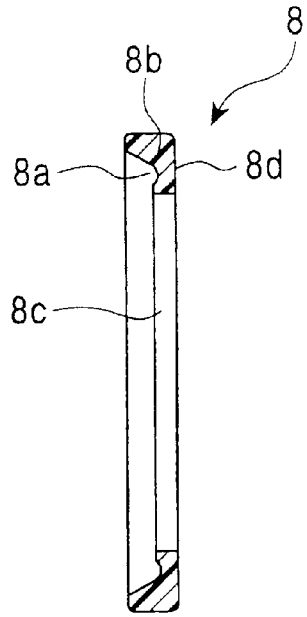
FIG. 15B is a sectional view of the spring receiving member according to an embodiment of the present invention.

The spring receiving member 8 is disposed in the annular guide portions 3 and 5 of the first and second interlock members 2 and 4, respectively. As best seen in FIGS. 15A and 15B, the spring receiving member 8 consists of a resin material, and has at the ring-like base portion 8*d* and a positioning portion 8*a* consisting of a recessed groove for the positioning of the upper end portion of the coil spring 9 (described below). The spring receiving member 8 also has at the ring-like base portion 8*d* an outer peripheral portion 8*b* and an inner peripheral portion 8*c*.

The spring receiving member 8 is guided by the guide portions 3 and 5 of the first and second interlock members 2 and 4, and is arranged such that the positioning portion 8*a* is oriented downwards. In this spring receiving member 8, the outer peripheral portion 8*b* and the inner peripheral portion 8*c* are guided by the guide surface 3*a* of the guide portion 3 of the first interlock member 2. The outer peripheral portion 8*b* is also guided by the guide surface 5*a* of the guide portion 5 of the second interlock member 4. The inner peripheral portion 8*c* is also guided by the arcuate connecting portion 4*a*.

It should be appreciated that the movement of the spring receiving member 8 moves when the first and second interlock members 2 and 4 are rotated, and is guided by the first and second interlock members 2 and 4. While in the above description both the outer peripheral portion 8*b* and the inner peripheral portion 8*c* of the spring receiving member 8 are both guided, it is also possible to guide only the outer peripheral portion 8*b* or the inner peripheral portion 8*c*. That is, the guide portions 3 and 5 of the first and second interlock members 2 and 4 may be constructed such that the outer peripheral portion 8*b* or/and the inner peripheral portion 8*c* of the spring receiving member 8 can be guided in the vicinity of the support portions 2*d*, 2*f*, 4*d* and 4*e* of the first and second interlock members 2 and 4.

As best seen in FIG. 5, the protrusions 2*j*, 2*k*, 4*h* and 4*k* of the first and second interlock members 2 and 4 abut the upper surface of the base portion 8*d* (on the opposite side of positioning portion 8*a*). When the operating shaft 6 is inclined and the first and second interlock members 2 and 4 are rotated, the spring receiving member 8 is pressed by one of the protrusions 2*j*, 2*k*, 4*h* and 4*k*, and inclined against the biasing force of the coil spring 9, as shown in FIGS. 2 and 4.

As shown in FIG. 1, the spring receiving member 8 is constantly elastically biased upwards by a coil spring 9. The upper end portion of this coil spring 9 is positioned by the positioning portion 8*a* of the spring receiving portion 8. The positioning portion 8*a* has a recessed configuration that (see FIG. 15B) positions the outer peripheral portion and the inner peripheral portion of the coil spring 9 within the positioning portion 8*a*. However, it is also possible to utilize other shapes for the positioning portion 8*a*, such as an L-shaped configuration (not shown), to effect the positioning of only the outer peripheral portion or the inner peripheral portion of the coil spring 9.

Figure 17:
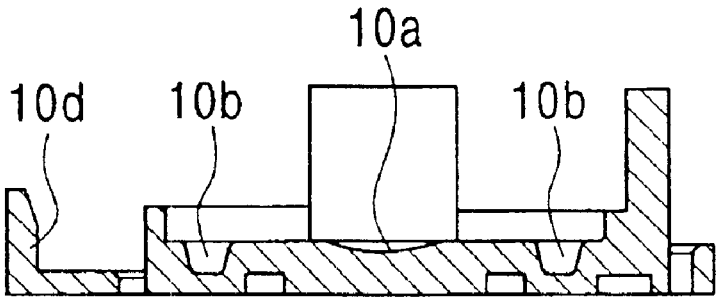
FIG. 17 is a sectional view of the bottom plate according to an embodiment of the present invention taken along the line XVII—XVII of FIG. 16.
Figure 18:
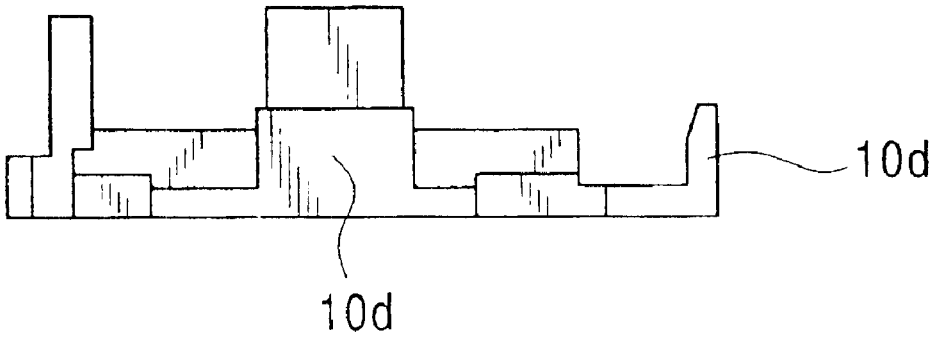
FIG. 18 is a front view of the bottom plate according to an embodiment of the present invention.

The lower portion of the frame body 1 is enclosed by a bottom plate 10, which supports the lower end portion of the coil spring 9. This bottom plate 10 will be described with reference to FIGS. 16 through 18. The bottom plate 10 has a substantially rectangular outer configuration, and at the center thereof, there is formed an arcuate restricting portion 10*a* for restricting the downward movement of the operating shaft 6 when a downward load is erroneously applied to the operating shaft. This restricting portion 10*a* is constructed such that when the operating shaft 6 is erroneously pressed downwards, the lower end of the second operating portion 6*b* of the operating shaft 6 abuts the restricting portion 10*a*. This insures that an excessive load is not applied to the first interlock member 2 rotatably supporting the operating shaft 6.

Figure 2:
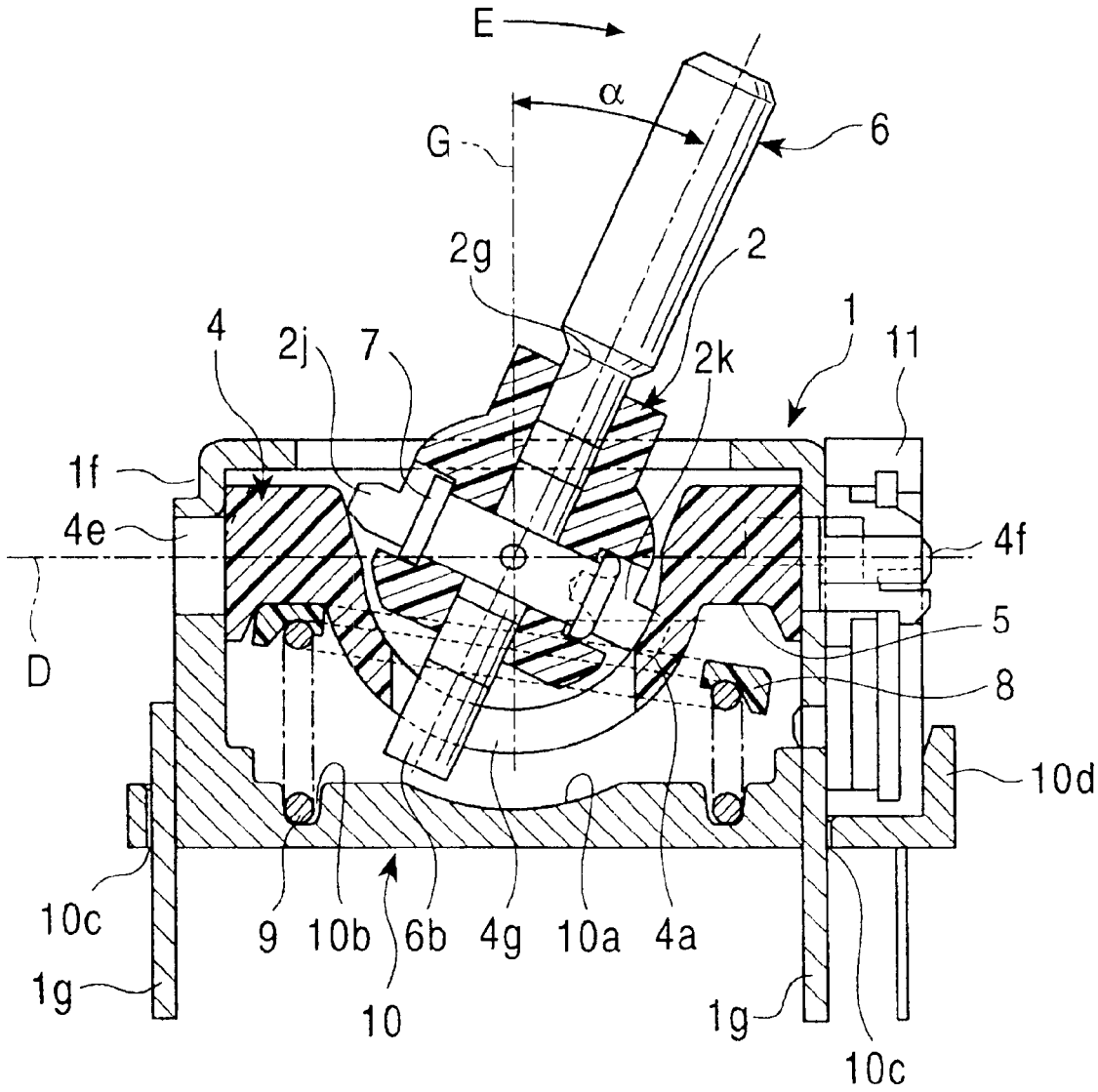
FIG. 2 is a sectional view illustrating the operation of a first interlock member according to an embodiment of the present invention.
Figure 3:
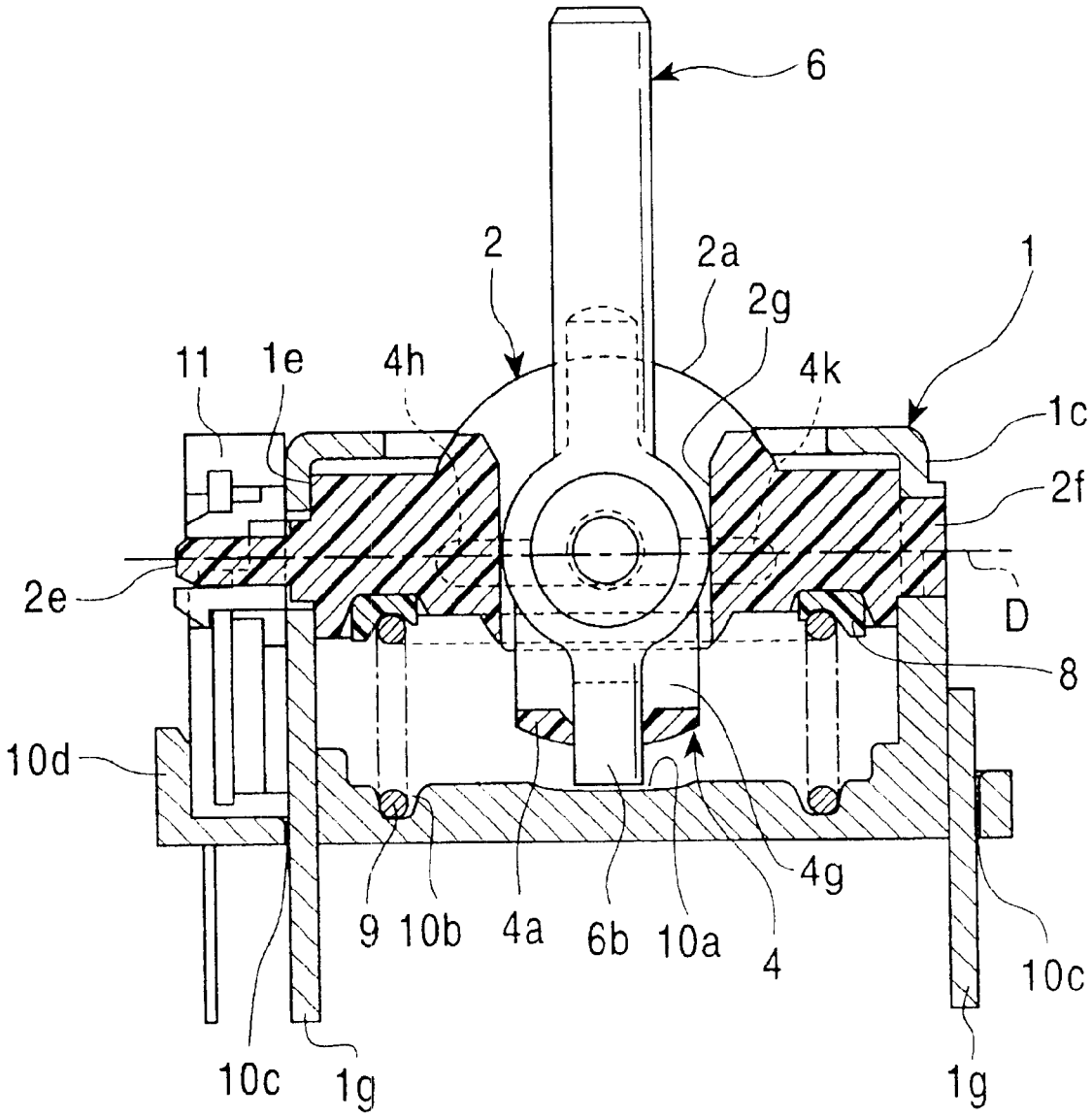
FIG. 3 is a sectional view of a multidirectional input device according to an embodiment of the present invention taken along the line II—II of FIG. 5.
Figure 4:
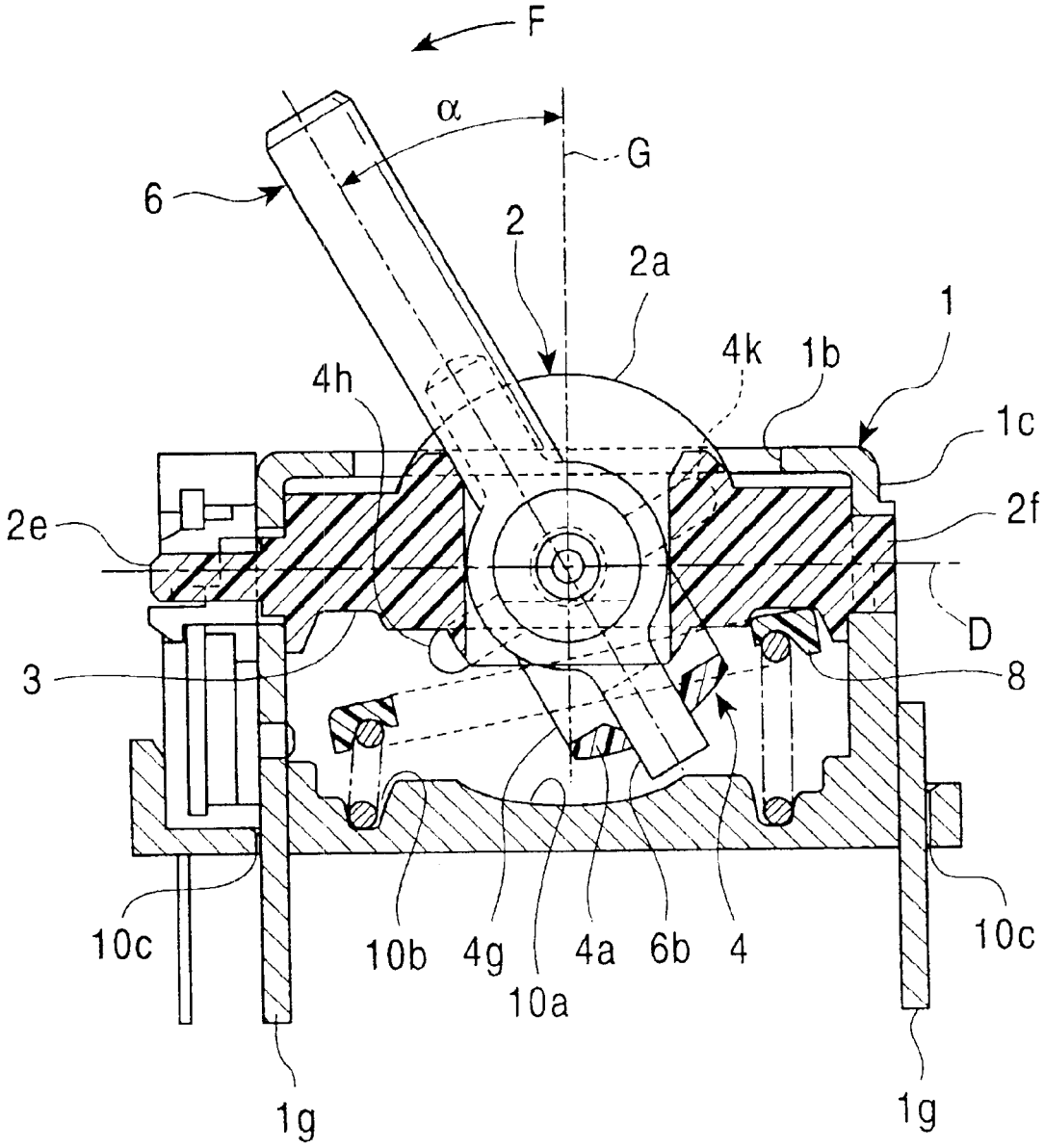
FIG. 4 is a sectional view illustrating the operation of a second interlock member according to an embodiment of the present invention.

As shown in FIGS. 2 and 4, the maximum operating angle $\alpha$ of the operating shaft 6 is set to be approximately 25 degrees. So long as the operating shaft 6 is not inclined beyond the maximum degree, the second operating portion 6*b* of the operating shaft 6 will not detach or separate from the restricting portion 10*a*.

On the outer side of the restricting portion 10*a*, there is formed in an annular configuration a positioning groove 10*b* of a predetermined depth for positioning the lower end portion of the coil spring 9. Further, at substantially the center of the four somewhat rectangular side surfaces, square holes 10*c* are formed. Mounting legs 1*g* (as shown in FIG. 1) extending downwardly from the side plates 1*c*, 1*d*, 1*e* and 1*f* are inserted into these square holes 10*c* when the frame body 1 is assembled to the bottom plate 10.

Figure 16:
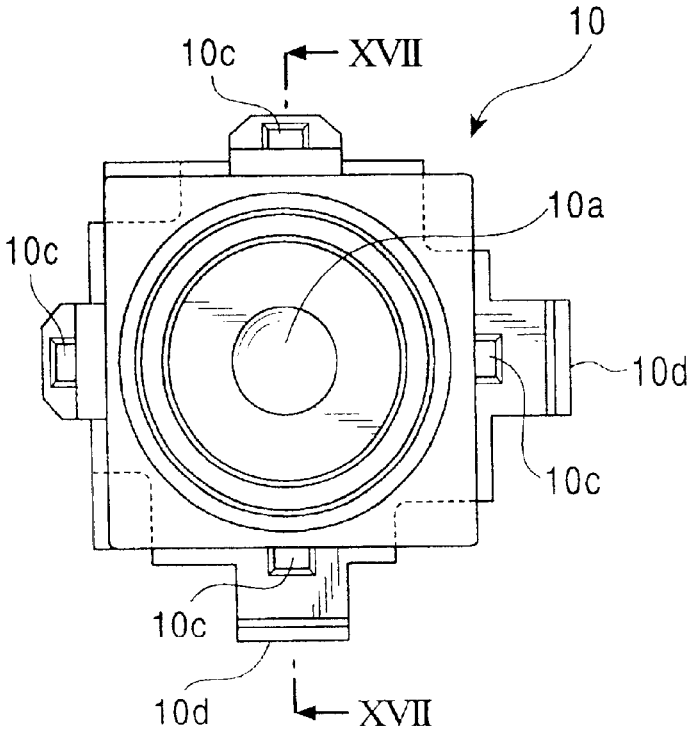
FIG. 16 is a plan view of a bottom plate according to an embodiment of the present invention.

Further, in the right-hand and lower side surface of the bottom plate 10, as shown in FIG. 16, there are formed mounting walls 10*d* for mounting the rotary electric parts 11 (to be described below).

In this multidirectional input device of the present invention, the coil spring 9 provides a biasing force against the support portions 2*d*, 2*f*, 4*d* and 4*f* of the first and second interlock members 2 and 4. If the operating shaft 6 is inclined as shown in FIGS. 2 and 4, the biasing force of the coil spring 9 will automatically restored the operating shaft 6 to the neutral position.

Figure 19:
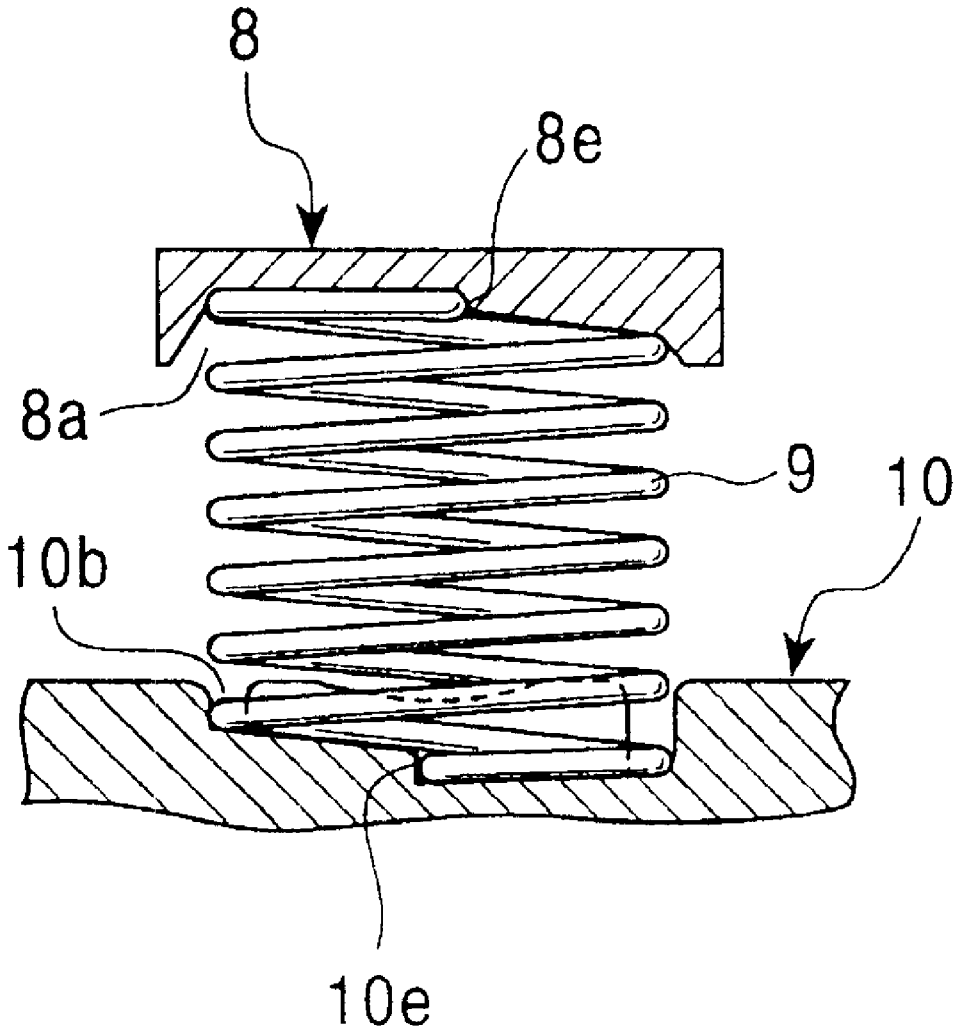
FIG. 19 is a diagram illustrating a modification of a coil spring positioning method according to an embodiment of the present invention.
Figure 20:
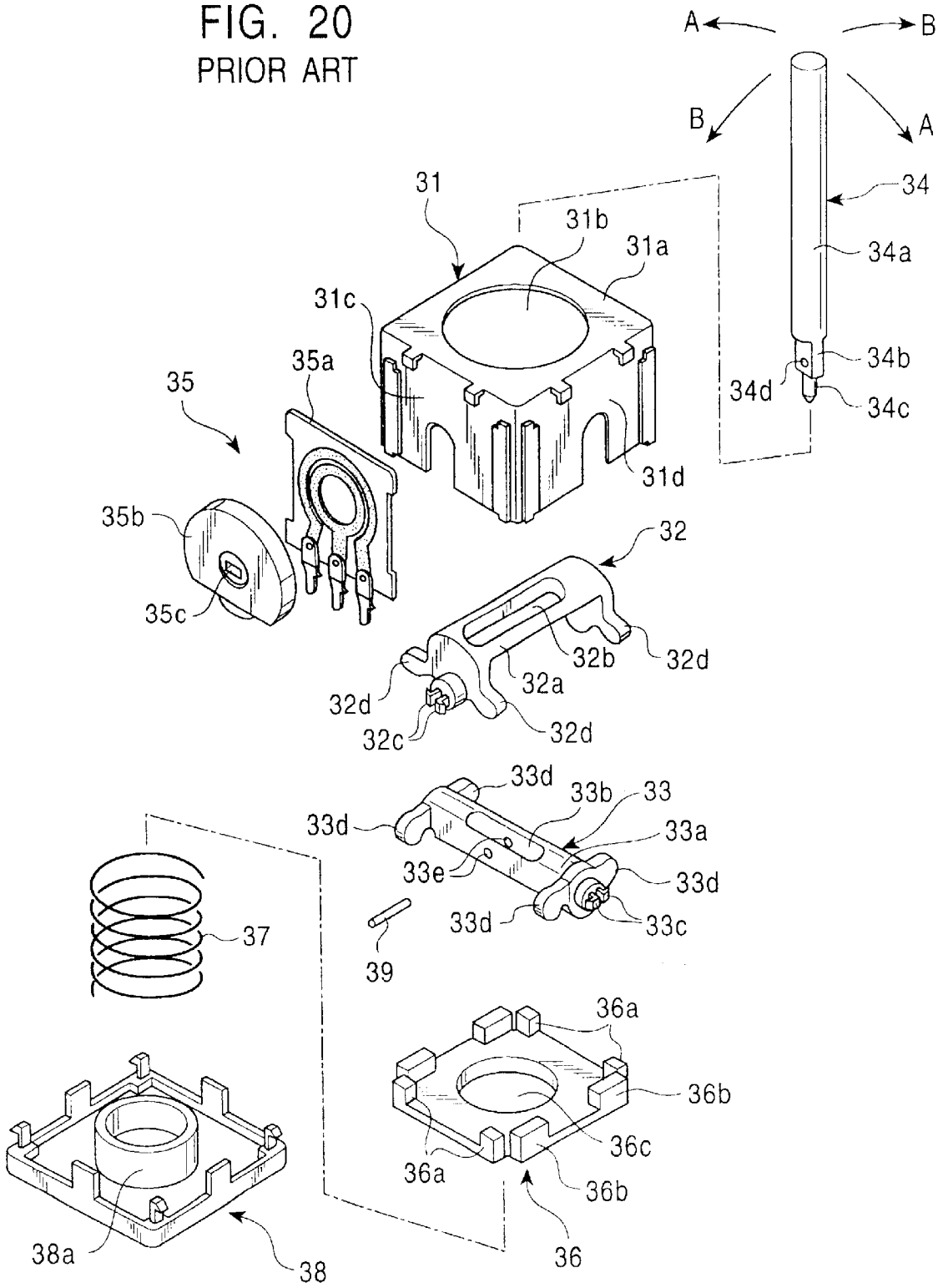
FIG. 20 PRIOR ART
FIG. 20 is an exploded perspective view of a conventional multidirectional input device.
Figure 21A:
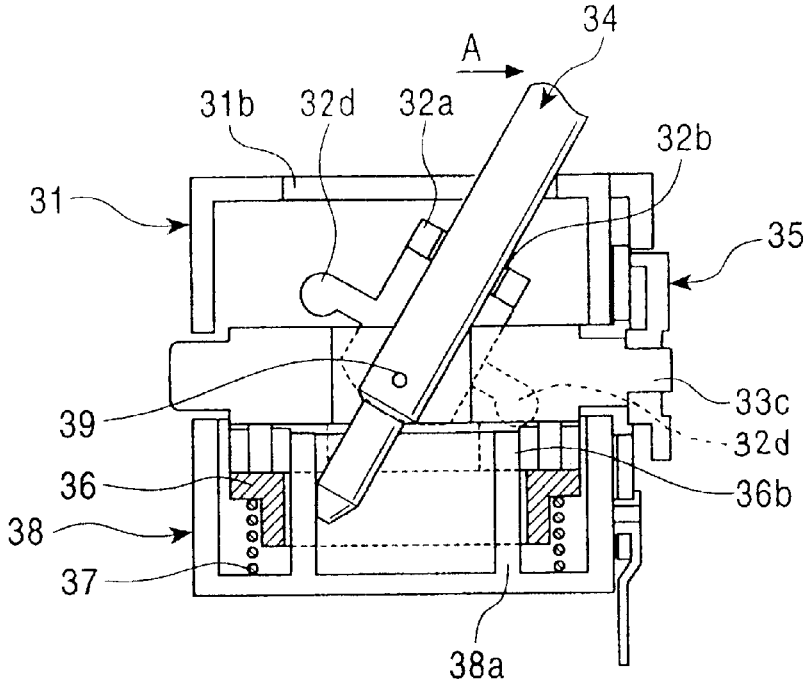
FIG. 21A PRIOR ART
FIGS. 21A and 21B are diagrams illustrating the operation of the conventional multidirectional input device.
Figure 21B:
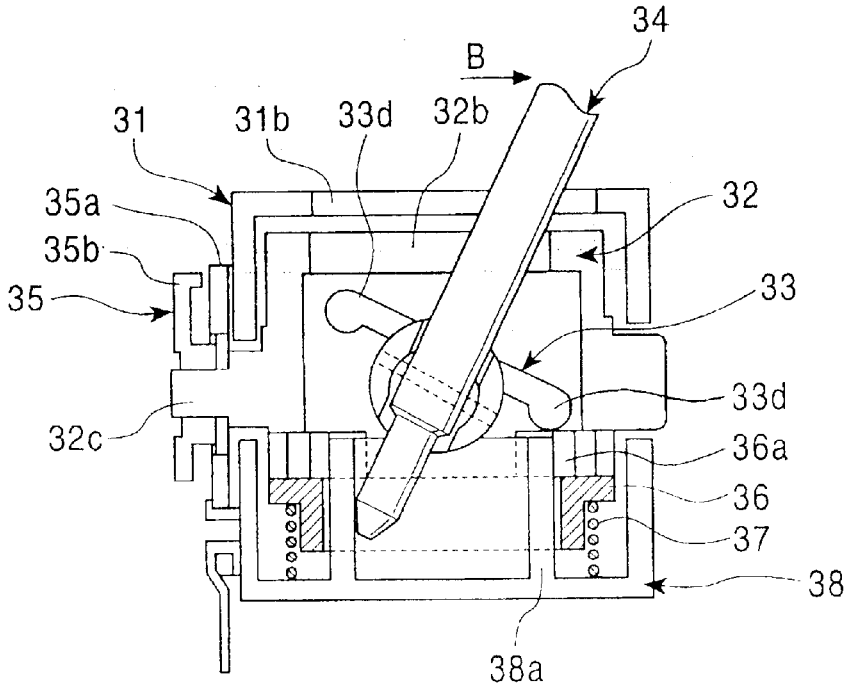
FIG. 21B PRIOR ART

As shown in FIG. 19, the upper and lower end portions of the coil spring 9 include steps formed by the winding start and winding end of the coil spring 9. These steps are formed in the production of the coil spring 9. Although it might be possible to eliminate the steps by performing grinding or the like on the upper and lower end portions of the coil spring 9, the grinding or the like represents an increase in manufacturing costs, and is typically avoided.

In preferred embodiment of the present invention, steps 8*e* and 10*e* are formed in the positioning portion 8*a* of the spring receiving member 8 and the positioning groove 10*b* of the bottom plate 10, respectively, to accommodate the steps of the coil spring 9. By providing the steps 8*e* and 10*e* in the spring receiving member 8 and the bottom plate 10, it is possible for the biasing force of the coil spring 9 to be uniformly distributed against the spring receiving member 8 and the bottom plate 10. This results in a constant operating force that is experienced by the operator when the operating shaft 6 is inclined.

The operation of this multidirectional input device of the present invention will be described with reference to FIGS. 1 through 5. FIG. 1 shows the operating shaft 6 in a vertical, neutral position. As the operating shaft 6 is inclined in the direction of the arrow E (as shown in FIG. 2) then the first interlock member 2 is rotated and the protrusion 2*k* pressurizes the spring receiving member 8. This causes the right-hand side portion of the spring receiving member 8 to descend and the right-hand portion of the coil spring 9 to be compressed. At this time, the rotary electric part 11, which is engaged with the engagement portion 4*f* of the first interlock member 2 (shown in FIG. 3), is rotated. This results in a change in the resistance value of the rotary electric part 11, which is, for example, a variable resistor.

As shown in FIG. 4, when the operating shaft 6 is inclined in the direction of arrow F, the second interlock member 4 is rotated, and the protrusion 4*h* presses the left-hand side portion of the spring receiving member 8. This causes the left-hand side portion of the coil spring 9 to compress. At this time, the rotary electric part 11 engaged with the engagement portion 2*e* of the second interlock member 2 (shown in FIG. 1) is rotated, thereby changing the resistance value of the variable resistor.

It should be understood that the operating shaft 6 may be inclined in a direction obtuse to those mentioned above, making it possible to drive both rotary electric parts 11 through a combination of the above operations.

In the embodiment described above, the first and second interlock members 2 and 4 are directly held by the frame body 1. However, it is also possible to omit, for example, the support portions 2*d* and 2*f*, and indirectly hold the first and second interlock members 2 and 4 to the frame body 1 by means of the rotary electric parts 11.

In the multidirectional input device of the present invention, the connecting portion 4*a* of the second interlock member 4 is arranged below the first interlock member 2 so as to be astride the first interlock member 2, and the connecting portion 4*a* is positioned within the inner peripheral portion of the coil spring 9, so that it is possible to diminish the gap between the first and second interlock members 2 and 4 and the top plate of the frame body 1. Thus, it is possible to reduce the height of the frame body 1, making it possible to provide a thinner multidirectional input device.

Further, the connecting portion 4*a* of the second interlock member 4 is positioned within the inner peripheral portion of the coil spring 9, so that it is possible to effectively utilize the vacant space of the inner peripheral portion of the coil spring 9, making it possible to easily rotate the first and second interlock members 2 and 4.

Further, the connecting portion 4*a* of the second interlock member is 4 formed in an arcuate configuration, and the center of the arc is positioned at the pivot portion rotatably supporting the operating shaft 6 of the first interlock member 2, so that, when the operating shaft 6 is inclined, always the same portion of the second operating portion 6*b* of the operating shaft 6, moving within the second elongated hole 4*g* of the connecting portion 4*a*, moves within the second elongated hole 4*g*. Thus, it is possible to smoothly incline the operating shaft 6, making it possible to provide a multidirectional input device giving an improved operational feeling.

Further, the support portions 2*d*, 2*f*, 4*d* and 4*e* of the first and second interlock members 2 and 4 are supported at the same height within the frame body 1, so that it is possible to make the operational force of the operating shaft 6, when rotating the first and second interlock members 2 and 4, uniform, making it possible to improve the operational feeling.

Further, since the coil spring 9 provides a biasing force in the vicinity of the support portions 2*d*, 2*f*, 4*d* and 4*e* of the first and second interlock members 2 and 4, when the operational force applied to the operating shaft 6 is removed, the operating shaft 6 is automatically and reliably restored to the neutral position. Thus, it is possible to provide a multidirectional input device giving a satisfactory operability.

Further, between the first and second interlock members 2 and 4 and the coil spring 9, there is arranged a spring receiving member 8 capable of positioning this coil spring 9, and through the inclination of the operating shaft 6, the movement of the spring receiving member 8 is guided by the first and second interlock members 2 and 4 so that there is nothing which hinders the movement of the spring receiving member 8, making it possible to smoothly inline or vertically move the spring receiving member. Thus, it is possible to provide a multidirectional input device giving a satisfactory operational feeling of the operating shaft.

Further, there is provided guide portions 3 and 5 on the first and second interlock members 2 and 4, respectively, that are capable of guiding the movement of the spring receiving member 8, so that it is possible to reliably guide the inclination or the vertical movement of the spring receiving member 8, making it possible to provide a multidirectional input device having improved reliability.

In addition, the guide portions 3 and 5 are provided in the vicinity of the support portions 2*d*, 2*f*, 4*d* and 4*e* of the first and second interlock members 2 and 4, so that it is possible to reliably bias the first and second interlock members 2 and 4, upwardly and elastically with a coil spring 9 having small elastic force. Thereby insuring that the operability of the operating shaft 6 is satisfactory.

Further, the inner peripheral portion 8*c* of the spring receiving member 8 is positioned against the connecting portion 4*a* of the second interlock member 4, and the movement of the spring receiving member 8 is thereby guided efficiently in terms of space, making it possible to provide a smaller multidirectional input device.

Further, the guide surfaces 3*a* and 5*a* are formed in a tapered configuration so that, when the spring receiving member 8 is inclined or vertically moved, it is possible to reliably guide the spring receiving member 8 with the tapered surface even if a part of the spring receiving member 8 is detached from the guide portions 3 and 5.

Further, in the spring receiving member 8, there is provided a positioning portion 8*a* for positioning the upper end portion of the coil spring 9, so that, even if the spring receiving member 8 is inclined or vertically moved, it is possible to maintain the position of the coil spring within the positioning portion 8*a*. Moreover, the positioning portion 8*a* is formed such that at least one of the outer and inner peripheral portions of the coil spring 9 can be positioned reliably.

Further, in the positioning portion 8*a* of the spring receiving member 8, there is formed a step portion 8*e* for the step generated at the winding start of the coil spring 9, so that it is possible to uniformly transmit the biasing force of the coil spring 9 to the spring receiving member 8, so that the operational force of the operating shaft 6 is constant.

Further, the frame body 1 has a bottom plate 10 for closing the lower portion, and there is formed in this bottom plate 10 a positioning groove 10*b* for positioning the lower end portion of the coil spring 9, so that the upper and lower end portions of the coil spring 9 are positioned the movement of the coil spring 9 is controlled.

Moreover, in the positioning groove 10*b* of the bottom plate 10, there is formed a step portion 10*e* for accommodating the step generated at the winding end of the coil spring 9, so that it is possible to uniformly transmit the biasing force of the coil spring 9 to the spring receiving member 8 so as to insure that the operational force of the operating shaft 6 is constant.

Further, there is formed in the bottom plate 10 a restricting portion 10*a* for restricting the downward movement of the operating shaft 6 when a downward load is applied to the operating shaft 6, wherein the lower end portion of the operating shaft 6 abuts the restricting portion 10*a* if a downward load is erroneously applied to the operating shaft 6. Thus, it is possible to prevent an excessive load from being applied to the first interlock member 2 that rotatably supports the operating shaft 6.

What is claimed is:

1. A multidirectional input device comprising:

a frame body having an interior area;

a first interlock member rotatably supported by the frame body and having a first elongated hole;

a second interlock member arranged in a direction perpendicular to the first interlock member, said second interlock member being rotatably supported by the frame body and having a second elongated hole;

an operating shaft for rotating the first and second interlock members, the operating shaft being disposed within the first elongated hole and rotatably supported by the first interlock member so as to be pivotal within the first elongated hole, said operating shaft having a lower end portion that engages the second elongated hole of the second interlock member, said lower end portion being movable along said second elongated hole;

a coil spring for providing an elastic biasing force to the first and second interlock members; and a plurality of electric parts which can be operated by the rotation of the first and second interlock members, wherein support portions are provided at both ends of the first and second interlock members for supporting the first and second interlock members inside the frame body, wherein the second interlock member comprises a connecting portion between the support portions, the connecting portion having downwardly protruding U-shape, the second elongated hole being disposed within the connecting portion, wherein the connecting portion is arranged below the first interlock member so that the second interlock member is astride the first interlock member and the connecting portion is substantially below the first interlock member, the connecting portion being substantially disposed within an inner volume of the coil spring, wherein, when the operating shaft is tilted along the first elongate hole of the first interlock member, the operating shaft rotates about a second line of rotation that intersects the support portions at each end of the second interlock member and the lower end portion of the operating shaft engages a side of the second elongate hole of the second interlock member so as to rotate the second interlock member about the second line of rotation, and wherein, when the operating shaft is tilted along the second elongate hole of the second interlock member, the operating shaft rotates about a first line of rotation that intersects the support portions at each end of the first interlock member so as to rotate the first interlock member about the first line of rotation.

2. A multidirectional input device according to claim 1, wherein the connecting portion is formed in an arcuate configuration, the center of which is aligned with the connection between the operating shaft and the first interlock member.

3. A multidirectional input device according to claim 1, wherein the support portions of the first and second interlock members are positioned on a single plane.

4. A multidirectional input device according to claim 1, wherein the biasing force of the coil spring is applied to the first and second interlock members in the vicinity of the support portions of the first and second interlock members.

5. A multidirectional input device according to claim 1, wherein there is provided between the first and second interlock members and the coil spring a spring receiving member, and wherein the spring receiving member is moved and guided by the first and second interlock members when the first and second interlock members are rotated.

6. A multidirectional input device according to claim 5, wherein a guide portion for guiding the movement of the spring receiving member is provided on a lower surface of the first and second interlock members.

7. A multidirectional input device according to claim 6, wherein the guide portion is formed in the vicinity of the support portions of the first and second interlock members, and wherein at least the outer peripheral portion or the inner peripheral portion of the spring receiving member is guided by the guide portion.

8. A multidirectional input device according to claim 7, wherein the inner peripheral portion of the spring receiving member is positioned against the connecting portion of the second interlock member so as to guide the movement of the spring receiving member.

9. A multidirectional input device according to claim 6, wherein the guide portion is formed in a tapered configuration.

10. A multidirectional input device according to claim 5, wherein the spring receiving member is provided with a positioning portion for positioning an upper end portion of the coil spring.

11. A multidirectional input device according to claim 10, wherein the positioning portion is formed so as to engage at least an outer peripheral portion or an inner peripheral portion of the coil spring.

12. A multidirectional input device according to claim 10, wherein the positioning portion of the spring receiving member comprises a step portion for accommodating a winding step in the coil spring.

13. A multidirectional input device according to claim 1, wherein the interior area of the frame body is enclosed by a bottom plate, and wherein the bottom plate comprises a positioning groove for positioning a lower end portion of the coil spring.

14. A multidirectional input device according to claim 13, wherein the positioning groove of the bottom plate comprises a step portion for accommodating a winding step formed in the coil spring.

15. A multidirectional input device according to claim 1, wherein the interior area of the frame body is enclosed by a bottom plate, the bottom plate comprising a restricting portion positioned so as to restrict the downward movement of the operating shaft when an excessive downward load is applied to the operating shaft, wherein the lower end portion of the operating shaft is spaced apart from the restricting portion when said excessive downward load is not applied to the operating shaft.

16. A multidirectional input device according to claim 5, wherein the spring receiving member comprises a ring shape having an open interior area, said open interior area being disposed about the connecting portion of the second interlock member.

17. A multidirectional input device according to claim 16, wherein the spring receiving member comprises groove in a lower surface thereof, said groove being configured to engage an upper end portion of the coil spring.

18. A multidirectional input device according to claim 17, wherein the groove of the spring receiving member comprises a step, said step being configured to engage a terminus of the coil spring.

* * * * *